US006798130B2

(12) United States Patent
Akoh et al.

(10) Patent No.: US 6,798,130 B2
(45) Date of Patent: Sep. 28, 2004

(54) DEFLECTION YOKE AND CATHODE RAY TUBE APPARATUS PROVIDED WITH THE SAME

(75) Inventors: Nobuhiko Akoh, Nitta-gun (JP); Tohru Takahashi, Osato-gun (JP); Masatsugu Inoue, Kumagaya (JP); Takashi Murai, Fukaya (JP); Tadahiro Kojima, Kumagaya (JP); Yoshiaki Ito, Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 9 days.

(21) Appl. No.: 09/908,686

(22) Filed: Jul. 20, 2001

(65) Prior Publication Data

US 2002/0008458 A1 Jan. 24, 2002

(30) Foreign Application Priority Data

Jul. 21, 2000 (JP) ..... 2000-220990
Jul. 24, 2000 (JP) ..... 2000-222919
Apr. 27, 2001 (JP) ..... 2001-133464

(51) Int. Cl.[7] ..... H01J 29/76

(52) U.S. Cl. ..... 313/440; 313/442; 313/421; 313/428; 313/412; 335/210; 335/212; 335/213

(58) Field of Search ..... 313/440, 442, 313/421, 428, 461, 412; 335/210–214; 220/2.1 A, 2.1 R

(56) References Cited

U.S. PATENT DOCUMENTS 3,806,750 A 4/1974 Tsuneta et al.
4,143,345 A * 3/1979 Barkow ..... 335/212
4,246,560 A * 1/1981 Shimizu et al. ..... 335/212
4,277,767 A * 7/1981 Ura ..... 335/210
4,553,120 A * 11/1985 Dam ..... 335/210
5,138,290 A * 8/1992 Togane et al. ..... 335/210
5,455,483 A * 10/1995 Azzi et al. ..... 313/440
5,801,481 A * 9/1998 Yokota ..... 313/440
6,380,698 B1 * 4/2002 Dasgupta ..... 315/368.25
6,404,117 B1 * 6/2002 Soneda et al. ..... 313/440
6,452,321 B1 * 9/2002 Kojima ..... 313/440

FOREIGN PATENT DOCUMENTS

JP 11-265666 9/1999
JP 11-265668 9/1999
JP 2001155661 A * 6/2001 ..... H01J/29/76

* cited by examiner

*Primary Examiner*—Nimeshkumar D. Patel
*Assistant Examiner*—Sikha Roy
(74) *Attorney, Agent, or Firm*—Oblon, Spivak, McClelland, Maier & Neustadt, P.C.

(57) ABSTRACT

A deflection yoke of a cathode ray tube apparatus comprises a pair of saddle-type horizontal deflection coils located symmetrically with respect to a central axis and substantially in the shape of a truncated pyramid. A magnetic core substantially in the shape of a truncated cone is located coaxially around the horizontal deflection coils, and a pair of vertical deflection coils are wound on the magnetic core. A relation between a space vf between a large-diameter end portion of the magnetic core and each of the horizontal deflection coils and a space vr between a small-diameter end portion of the magnetic core and each of the horizontal deflection coils, with respect to the direction of a vertical axis perpendicular to the central axis, is given by vf≧vr.

16 Claims, 9 Drawing Sheets

| Z-direction distance (mm) | 0 | 15 | 25 | 35 | 45 | 50 |
|---|---|---|---|---|---|---|
| Separator | 3.6 | 7.0 | 12.2 | 16.2 | 22.3 | 24.8 |
| H coil | 5.6 | 9.0 | 14.2 | 18.2 | 24.3 | 26.8 |
FIG. 11
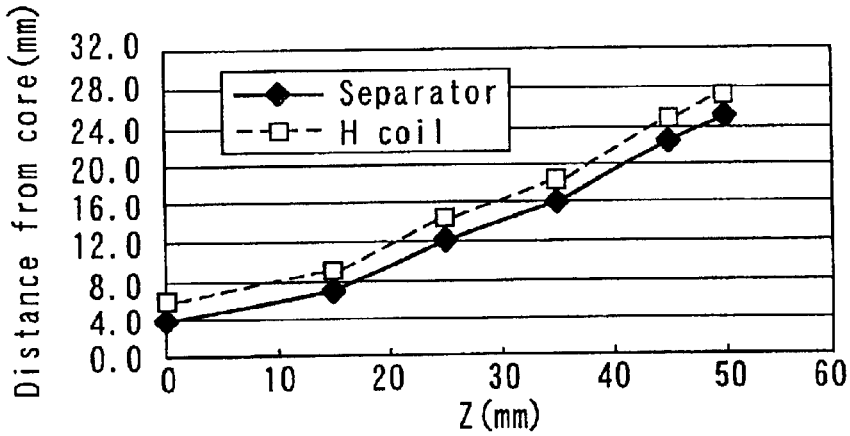
FIG. 12
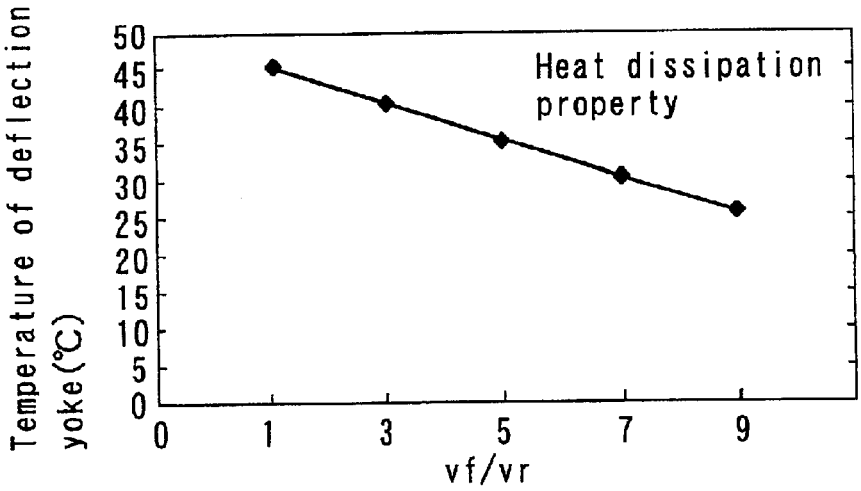
FIG. 13
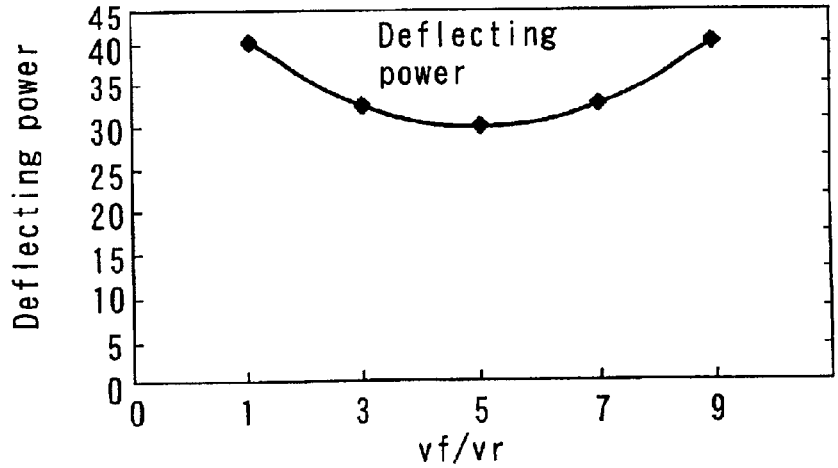
FIG. 14

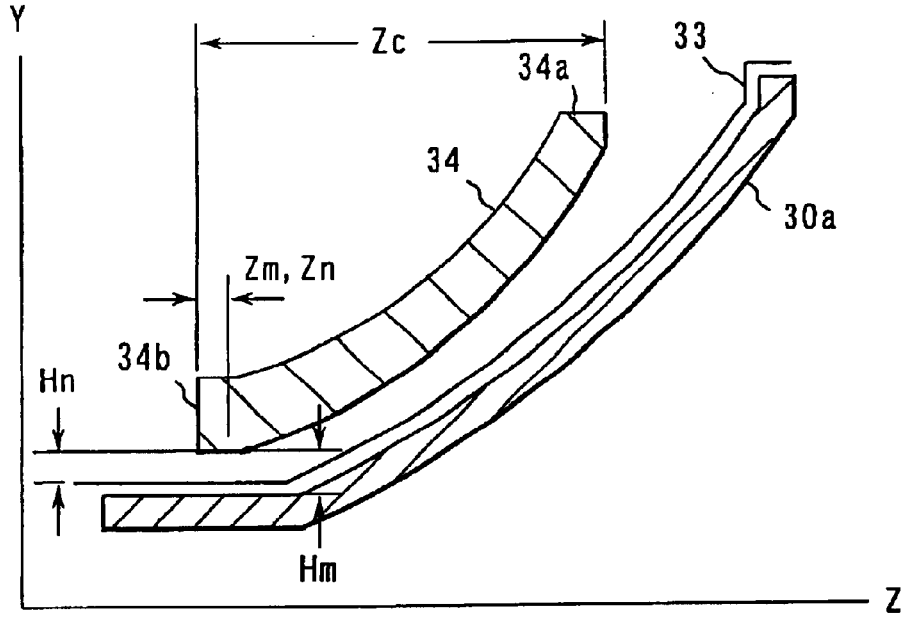
FIG. 17
| Z-direction distance (mm) | 0 | 2 | 5 | 8 | 10 | 20 | 30 | 37 |
|---|---|---|---|---|---|---|---|---|
| Space from separator (mm) | 3.5 | 3 | 3 | 4.5 | 5.5 | 8 | 11 | 15 |
| Space from H coil (mm) | 5.5 | 5 | 5 | 6.5 | 7.5 | 10 | 13 | 17 |
FIG. 18
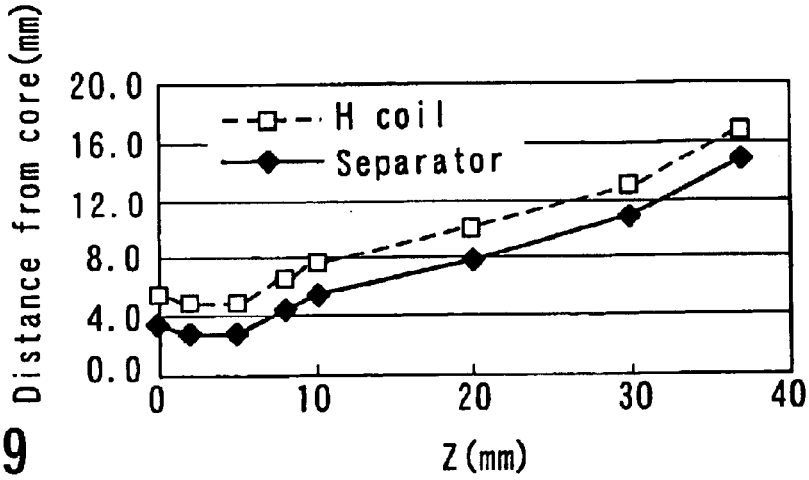
FIG. 19

| Z-direction distance (mm) | 0 | 2 | 5 | 8 | 10 | 20 | 30 | 37 |
|---|---|---|---|---|---|---|---|---|
| Separator | 3.5 | 3.0 | 3.0 | 4.0 | 4.5 | 9.5 | 14.0 | 17.5 |
| H coil | 5.5 | 5.0 | 5.0 | 6.0 | 6.5 | 11.5 | 16.0 | 19.5 |
FIG. 20
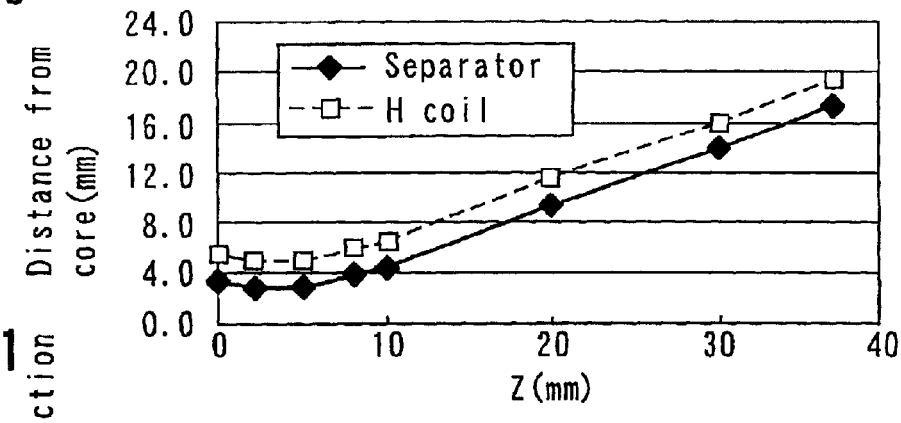
FIG. 21
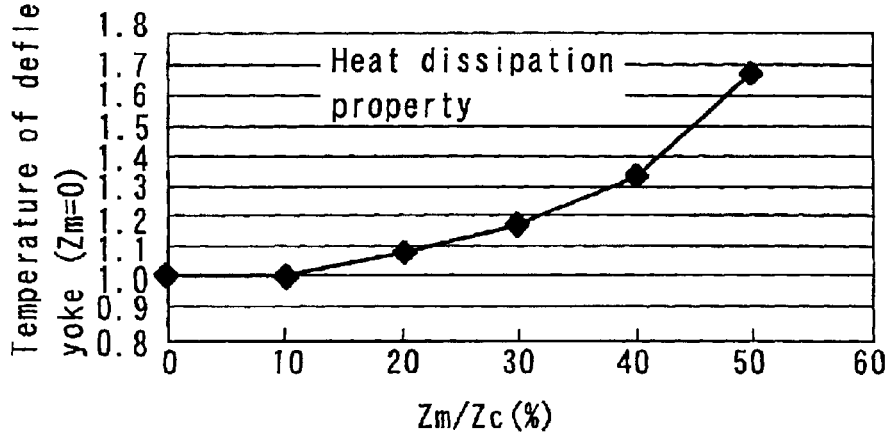
FIG. 22
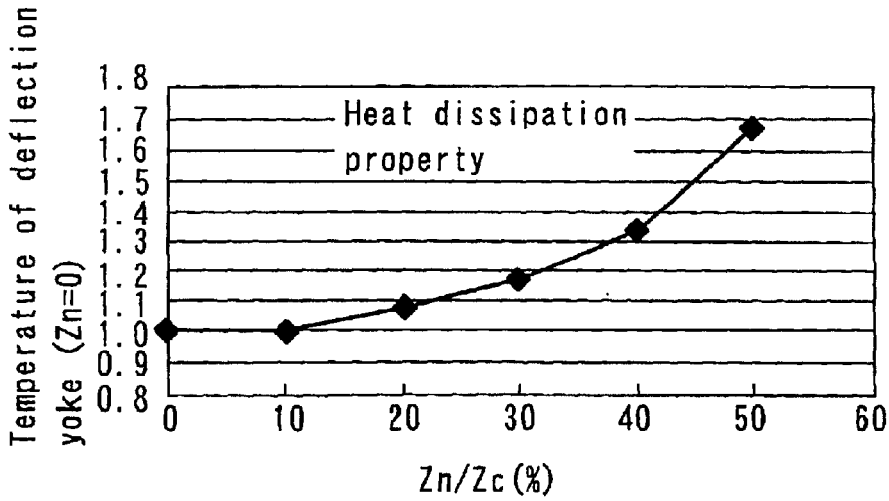
FIG. 23

DEFLECTION YOKE AND CATHODE RAY TUBE APPARATUS PROVIDED WITH THE SAME

CROSS-REFERENCE TO RELATED APPLICATIONS

This application is based upon and claims the benefit of priority from the prior Japanese Patent Applications No. 2000-220990, filed Jul. 21, 2000; No. 2000-222919, filed Jul. 24, 2000; and No. 2001-133464, filed Apr. 27, 2001, the entire contents of all of which are incorporated herein by reference.

BACKGROUND OF THE INVENTION

1. Field of the Invention

The present invention relates to a deflection yoke in a cathode ray tube apparatus such as a color picture tube and a cathode ray tube apparatus provided with the same.

2. Description of the Related Art

A cathode ray tube apparatus, e.g., a color picture tube, comprises a vacuum envelope that includes a glass panel including a substantially rectangular effective portion, a glass funnel connected to the panel, and a cylindrical glass neck connected to the small-diameter portion of the funnel. Formed on the inner surface of the effective portion of the panel is a phosphor screen, which includes a black light-shielding layer and dot- or stripe-shaped three-color phosphor layers that glow blue, green, and red, individually. A shadow mask having a large number of electron beam passage apertures is opposed to the phosphor screen in the vacuum envelope. Further, an electron gun that emits three electron beams is located in the neck, and a deflection yoke is mounted on a yoke mounting portion that is situated ranging from the outer periphery of the neck to the outer peripheral surface of the funnel.

In the color picture tube constructed in this manner, the three electron beams emitted from the electron gun are deflected horizontally and vertically by means of horizontal and vertical deflection magnetic fields that are generated from the deflection yoke, and the phosphor screen is scanned horizontally and vertically through the shadow mask, whereupon a color image is displayed.

A color picture tube of a self-convergence in-line type is widely used as a practical version. According to this color picture tube, an electron gun is constructed as an in-line type that emits three electron beams in a line on one and the same plane. A deflection yoke is designed to generate a horizontal deflection magnetic field of a pincushion type and a vertical deflection magnetic field of a barrel type. The three electron beams emitted in a line from the electron gun can be deflected by means of the horizontal and vertical deflection magnetic fields and concentrated on the whole screen area without requiring any special correcting means.

In the color picture tube constructed in this manner, on the other hand, the deflection yoke is a highly power-consuming element. It is essential, therefore, to reduce the power consumption of the deflection yoke in order to reduce the power consumption of the cathode ray tube. Modern cathode ray tubes are expected to ensure high resolution and improved visibility, and there are many working conditions that require high deflection frequencies. If the deflection yoke is operated with these high deflection frequencies, it releases a plenty of heat. Further, the deflection frequency must be increased in order to cope with application to high-definition monitors of TV sets or personal computers and other OA apparatuses. These situations result in increase in deflecting power and in the heat release of the deflection yoke.

In general, the deflecting power can be lowered by reducing the neck diameter of a cathode ray tube to lessen the outside diameter of a yoke mounting portion on which a deflection yoke is mounted, thereby narrowing the spaces for the action of deflection magnetic fields so that the deflection magnetic fields can efficiently act on electron beams.

In a conventional cathode ray tube apparatus having a yoke mounting portion in the shape of a truncated cone, however, electron beams pass in close vicinity to the inner surface of the yoke mounting portion of a vacuum envelope. Thus, if the neck diameter or the outside diameter of the yoke mounting portion is reduced further, the electron beams run against the inner surface of the yoke mounting portion before they reach a phosphor screen. Inevitably, therefore, the electron beams fail to run against some portions of the phosphor screen that correspond to the maximum deflection angle. If the electron beams continue to run against the inner surface of the yoke mounting portion, moreover, the temperature of the affected portion increases to a level such that glass melts, so that there is a possibility of the vacuum envelope imploding. With use of the conventional cathode ray tube apparatus, therefore, it is hard to lower the deflecting power by further reducing the neck diameter or the outside diameter of the yoke mounting portion.

If a rectangular raster is delineated on the phosphor screen, the region for the passage of the electron beams inside the yoke mounting portion on which a deflection yoke is mounted is substantially rectangular. As means for solving the above-mentioned problems, therefore, there is proposed a yoke mounting portion of a funnel of which the cross section is circular on the neck side and gradually changes into a substantially rectangular shape as the panel is approached.

If the yoke mounting portion of the funnel is thus formed substantially in the shape of a truncated pyramid, the diameters of the yoke mounting portion in the respective directions of its major (horizontal) and minor (vertical) axes can be shortened without changing the diagonal diameter corresponding to the widest deflection angle. Thus, the horizontal and vertical deflection coils of the deflection yoke can be brought close to the electron beams, so that the electron beams can be deflected efficiently, and the deflecting power can be lowered.

On the other hand, there are various types of deflection yokes, including a saddle-saddle type such that both horizontal and vertical deflection coils are of a saddle type, a semi-toroidal type such that horizontal and vertical deflection coils are of saddle and toroidal types, respectively, etc. A saddle-saddle deflection yoke described in Jpn. Pat. Appln. KOKAI Publication No. 11-265666, for example, comprises a pair of saddle-type horizontal deflection coils in the shape of a truncated pyramid located inside a separator formed of an insulator, a pair of saddle-type vertical deflection coils located outside the separator, and a magnetic core in the form of a truncated pyramid located externally covering the vertical deflection coils.

In the saddle-saddle deflection yoke having the basic construction described above, the deflecting power can be made lower than in a semi-toroidal deflection yoke. It is difficult, however, to form the magnetic core in the shape of a truncated pyramid, and the vertical deflection coils cannot be toroidally wound on the core of this shape with ease. Thus, the deflection yoke entails high manufacturing cost and lacks in general-purpose properties.

BRIEF SUMMARY OF THE INVENTION

The present invention has been contrived in consideration of these circumstances, and its object is to provide a deflection yoke capable of reduction in deflecting power and manufacturing cost and a cathode ray tube apparatus provided with the same.

In order to achieve the above object, a deflection yoke according to an aspect of the present invention comprises: a pair of saddle-type horizontal deflection coils located symmetrically with respect to a central axis on the opposite sides of a horizontal axis perpendicular to the central axis, individually, and substantially in the shape of a truncated pyramid as a whole; a magnetic core substantially in the shape of a truncated cone located coaxially with the central axis and surrounding the horizontal deflection coils; and a pair of vertical deflection coils wound on the magnetic core, the horizontal deflection coils and the magnetic core being arranged so that a relation between a space vf between the large-diameter end portion of the magnetic core and each of the horizontal deflection coils and a space vr between the small-diameter end portion of the magnetic core and each of the horizontal deflection coils, with respect to the direction of a vertical axis perpendicular to the central axis and the horizontal axis as viewed in the direction of the horizontal axis, is given by $vf \geqq vr$.

Further, a deflection yoke according to another aspect of the invention comprises a pair of saddle-type horizontal deflection coils located symmetrically with respect to a central axis and substantially in the shape of a truncated pyramid, a magnetic core substantially in the shape of a truncated cone located coaxially with the central axis and surrounding the horizontal deflection coils, and a pair of vertical deflection coils wound on the magnetic core, the horizontal deflection coils and the magnetic core being arranged so that a minimum space portion in which the space between the magnetic core and each of the horizontal deflection coils in the direction of a horizontal axis perpendicular to the central axis of each horizontal deflection coil has a minimum is provided near the small-diameter end portion of the core and that the space between the core and each horizontal deflection coil enlarges continuously from the minimum space portion to the large-diameter end of the core.

Furthermore, a deflection yoke according to another aspect of the invention comprises a pair of saddle-type horizontal deflection coils located symmetrically with respect to a central axis and substantially in the shape of a truncated pyramid, a separator located outside the horizontal deflection coils and substantially similar to the horizontal deflection coils in shape, a magnetic core substantially in the shape of a truncated cone located coaxially with the central axis and surrounding the separator, and a pair of vertical deflection coils wound on the magnetic core, the horizontal deflection coils and the magnetic core being arranged so that a minimum space portion in which the space between the magnetic core and the separator in the direction of a horizontal axis perpendicular to the central axis of each horizontal deflection coil has a minimum is provided near the small-diameter end portion of the core and that the space between the core and the separator enlarges continuously from the minimum space portion to the large-diameter end of the core.

A cathode ray tube apparatus according to an aspect of the present invention comprises: a vacuum envelope including a panel with a phosphor screen formed on the inner surface thereof, a funnel connected to the panel, and a cylindrical neck connected to the small-diameter end of the funnel, and formed having a yoke mounting portion in the shape of a truncated pyramid covering the outer periphery from the neck to the funnel; an electron gun located in the neck of the vacuum envelope and configured to emit electron beams toward the phosphor screen; and a deflection yoke mounted on the outside of the yoke mounting portion and configured to deflect the electron beams.

According to the deflection yoke and the cathode ray tube apparatus described above, the horizontal deflection coils are arranged substantially in the shape of a truncated pyramid. Therefore, electron beams can be deflected efficiently, so that the deflecting power can be lowered. With use of the magnetic core substantially in the shape of a truncated cone, moreover, the deflection yoke can be manufactured easily. Further, the heat dissipation property can be improved, so that heat release of the deflection yoke can be restrained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

FIGS. 1 to 4 show a color cathode ray tube apparatus according to a first embodiment of the present invention, in which:

FIG. 1 is a cutaway plan view of the color cathode ray tube apparatus;

FIG. 2 is a perspective view showing the rear side of a vacuum envelope of the cathode ray tube apparatus;

FIG. 4 is a perspective view showing a deflection yoke of the cathode ray tube apparatus;

FIG. 11 is a diagram showing the gap between the core and the horizontal deflection coil in the direction of the vertical axis of the deflection yoke, gap between the core and a separator, and Z-direction position;

FIG. 12 is a graph showing the relations between the gap between the core and the horizontal deflection coil in the direction of the vertical axis of the deflection yoke, gap between the core and the separator, and Z-direction position;

FIG. 13 is a graph showing the relation between vf/vr and the temperature of the deflection yoke; and FIG. 14 is a graph showing the relation between vf/vr and deflecting power.

FIGS. 15A to 23 show a color cathode ray tube apparatus according to a second embodiment of the invention, in which:

FIG. 15A is a front view showing a deflection yoke of the cathode ray tube apparatus;

FIG. 16 is a diagram schematically showing the relation between the gap between a core and a horizontal deflection coil in the direction of the horizontal axis of the deflection yoke and the gap between the core and a separator;

FIG. 17 is a diagram schematically showing the relation between the gap between the core and the horizontal deflection coil in the direction of the vertical axis of the deflection yoke and the gap between the core and the separator;

FIG. 18 is a diagram showing the gap between the core and the horizontal deflection coil in the direction of the horizontal axis of the deflection yoke, gap between the core and the separator, and Z-direction position;

FIG. 19 is a graph showing the relations between the gap between the core and the horizontal deflection coil in the direction of the horizontal axis of the deflection yoke, gap between the core and the separator, and Z-direction position;

FIG. 20 is a diagram showing the gap between the core and the horizontal deflection coil in the direction of the vertical axis of the deflection yoke, gap between the core and the separator, and Z-direction position;

FIG. 21 is a graph showing the relations between the gap between the core and the horizontal deflection coil in the direction of the vertical axis of the deflection yoke, gap between the core and the separator, and Z-direction position;

FIG. 22 is a graph showing the relation between Zm and the temperature of the deflection yoke; and FIG. 23 is a graph showing the relation between Zn and the temperature of the deflection yoke.

DETAILED DESCRIPTION OF THE INVENTION

Color cathode ray tube apparatuses according to embodiments of the present invention will now be described in detail with reference to the accompanying drawings.

Figure 1:
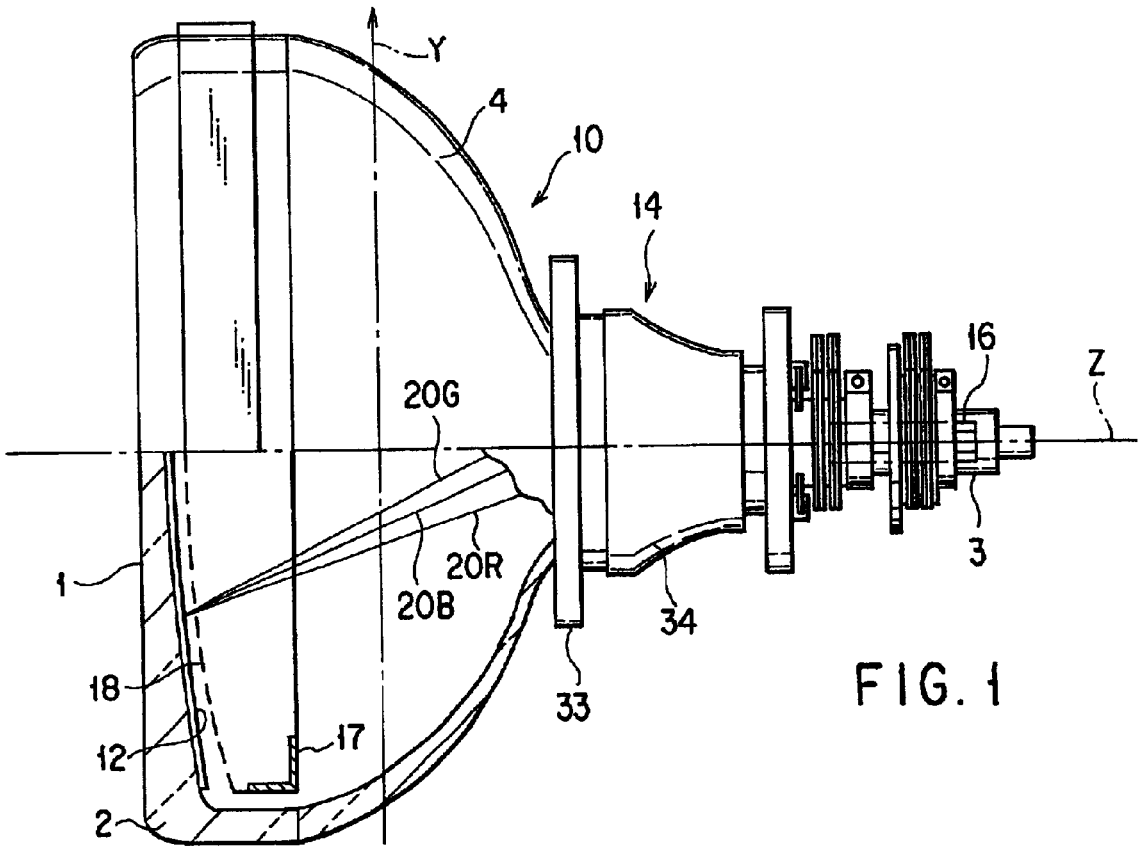
Figure 2:
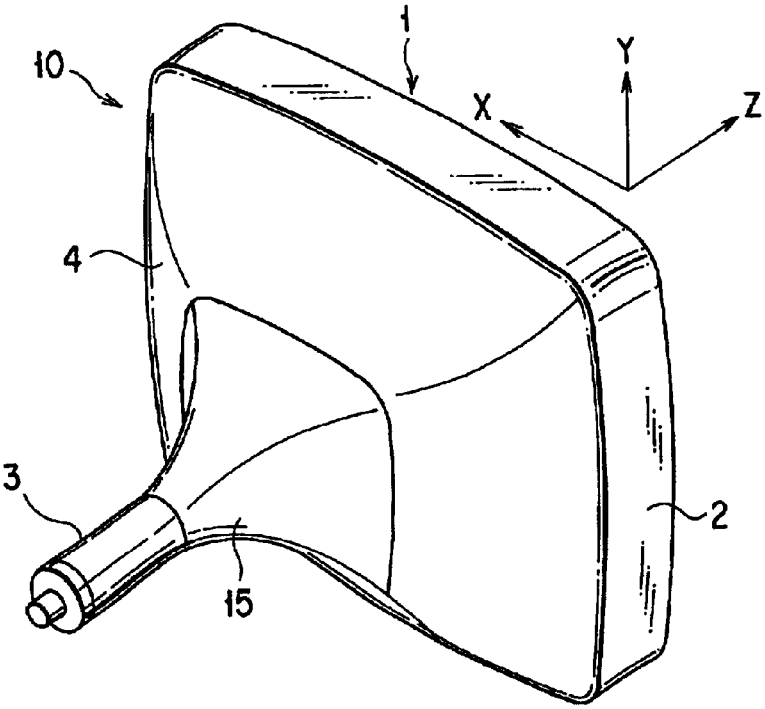
Figure 3A:
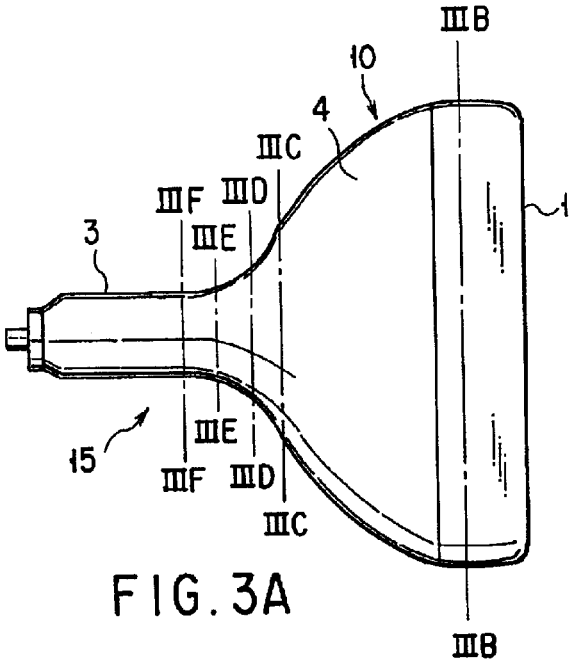
FIG. 3A is a side view of the vacuum envelope.
Figure 3B:
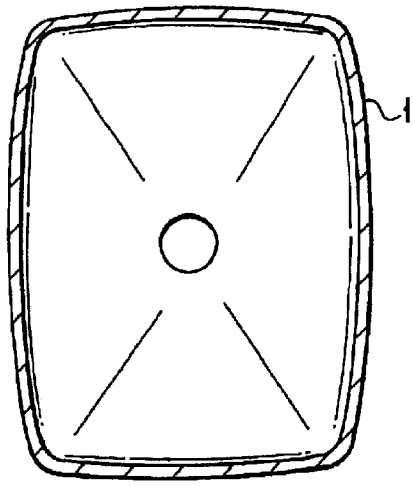
FIGS. 3B to 3F are sectional views taken along lines IIIB—IIIB, IIIC—IIIC, IIID—IIID, IIIE—IIIE and IIIF—IIIF of FIG. 3A, respectively.
Figure 3C:
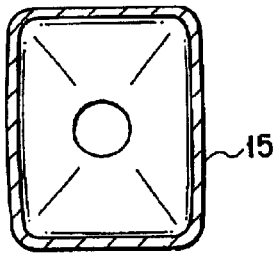
Figure 3D:
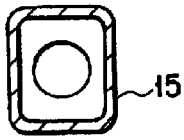
Figure 3E:
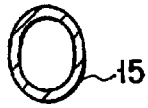
Figure 3F:
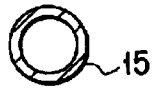
Figure 4:
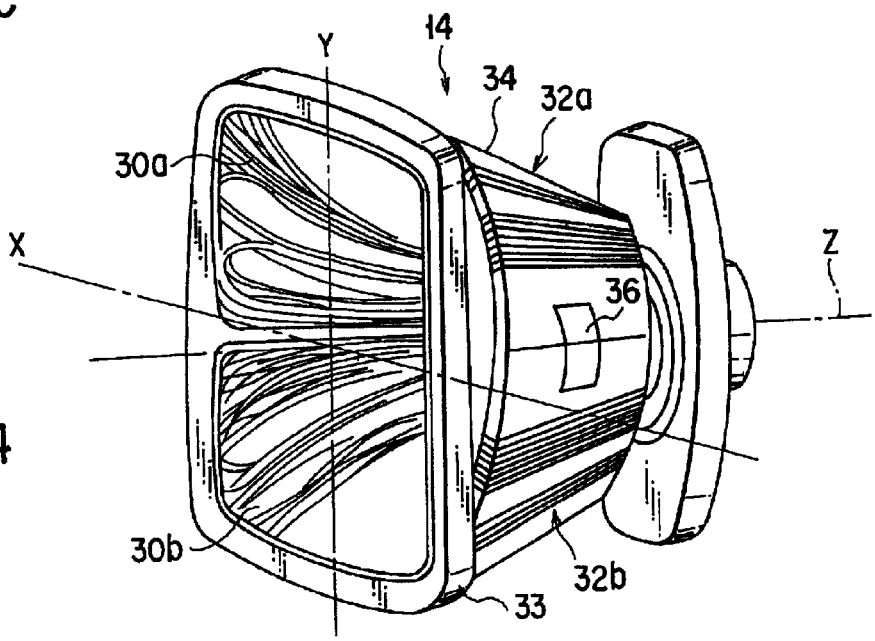
Figure 5:
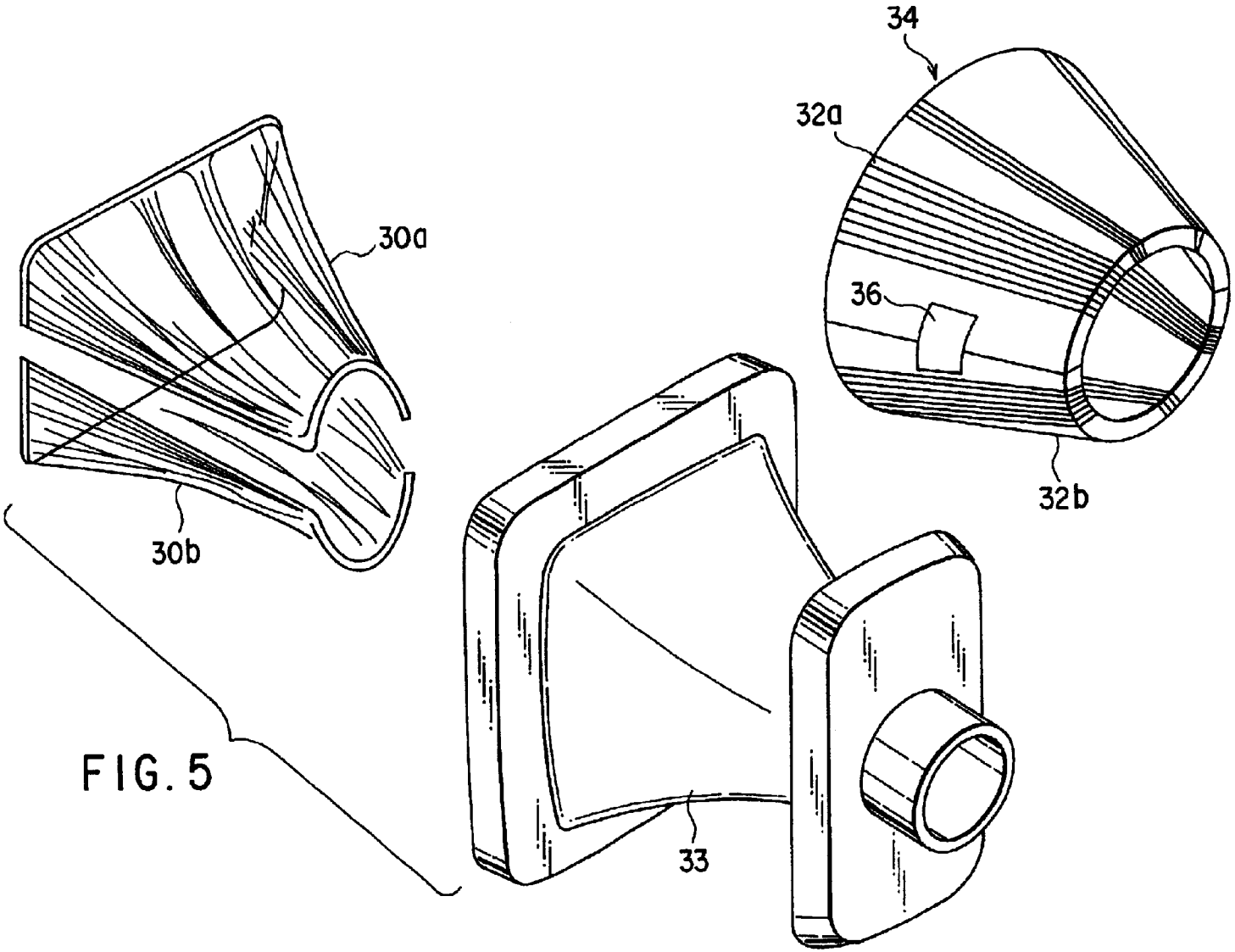
FIG. 5 is an exploded perspective view of the deflection yoke.
Figure 6:
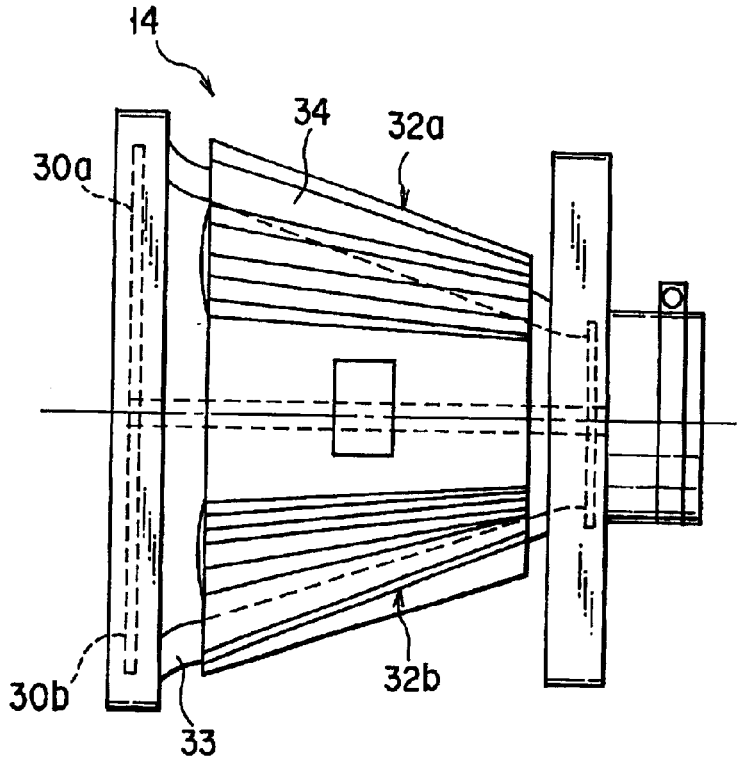
FIG. 6 is a side view of the deflection yoke.

As shown in FIGS. 1 and 2, a color cathode ray tube apparatus comprises a vacuum envelope 10, which includes a substantially rectangular panel 1 having a skirt portion 2 on its peripheral edge, a funnel 4 connected to the skirt portion of the panel, and a cylindrical neck 3 connected to the small-diameter portion of the funnel. The panel 1 has a substantially flat outer surface. Formed on the inner surface of the panel 1 is a phosphor screen 12, which is formed of a shielding layer and a plurality of phosphor layers that glow red, green, and blue, individually. A yoke mounting portion 15 is formed around the neck 3 and the funnel 4, and a deflection yoke 14 is mounted on the yoke mounting portion. Located in the neck 3, moreover, is an electron gun 16 that emits three electron beams 20R, 20G and 20B toward the phosphor layers of the phosphor screen 12.

A shadow mask 18 having a color screening function is supported on a mask frame 17 inside the panel 1. The shadow mask 18 is provided with a large number of electron beam apertures, whereby the electron beams 20R, 20G and 20B emitted from the electron gun 16 are screened by color so that they reach the phosphor layers corresponding to their respective colors.

The vacuum envelope 10 has a tube axis Z, a horizontal axis (long axis) X, and a vertical axis (short axis) Y. The tube axis Z, which is coaxial with the neck 3, extends through the center of the phosphor screen 12. The horizontal axis X extends at right angles to the tube axis Z. The vertical axis Y extends at right angles to the tube axis and the horizontal axis.

In the color cathode ray tube apparatus constructed in this manner, the electron beams 20R, 20G and 20B emitted from the electron gun 16 are deflected by means of horizontal and vertical deflection magnetic fields that are generated from the deflection yoke 14, and are screened by color by means of the shadow mask 18. Thereafter, the phosphor screen 12 is scanned horizontally and vertically, whereupon a color image is displayed.

As shown in FIGS. 2 and 3, the yoke mounting portion 15 of the vacuum envelope 10 has a shape such that its circular cross section on the neck 3 side gradually changes into a substantially rectangular cross section as the panel 1 is approached. Since the yoke mounting portion 15 is thus formed substantially in the shape of a truncated pyramid, the diameters of the deflection yoke 14 in the directions of the horizontal and vertical axes X and Y can be shortened. Accordingly, a horizontal deflection coil of the deflection yoke can be brought close to the electron beams to effect high-efficiency deflection, so that deflecting power can be lowered.

As shown in FIGS. 1, 4, 5 and 6, on the other hand, the deflection yoke 14 is provided with a pair of horizontal deflection coils 30*a* and 30*b*, which generate a magnetic field for deflecting the electron beams in the direction of the horizontal axis X, and a pair of vertical deflection coils 32*a* and 32*b*, which generate a magnetic field for deflecting the electron beams in the direction of the vertical axis Y. The horizontal deflection coils 30*a* and 30*b* are formed of a saddle-type coil each, and these two horizontal deflection coils are arranged together substantially into the form of a truncated pyramid. The horizontal deflection coils 30*a* and 30*b* are mounted along the inner surface of a separator 33 of a synthetic resin or the like. The separator 33 is substantially in the shape of a truncated pyramid corresponding to the yoke mounting portion 15.

A magnetic core 34 in the shape of a truncated cone is mounted on the outer peripheral side of the separator 33 and surrounds the separator coaxially. The vertical deflection coils 32*a* and 32*b* are toroidally wound on the core 34. The core 34 can be divided along a plane that contains its central axis. Halves of the core 34 are fixed to each other by means of a fixing piece 36.

In the deflection yoke 14, the inside or outside diameter of the panel-side end or large-diameter end portion of the core 34 is settled depending on the diagonal diameter on the large-diameter side of the horizontal deflection coils 30*a* and 30*b*, in consideration of the optimum position of the core 34, in the shape of a truncated cone, relative to the coils 30*a* and 30*b* in the shape of a truncated pyramid, and the length in the direction of the tube axis Z. Thus, if the horizontal deflection coils 30*a* and 30*b* are in the shape of a truncated pyramid and the core 34 in the shape of a truncated cone, the inner peripheral surface of the core is situated closest to the respective diagonal end portions of the horizontal deflection coils.

Figure 7:
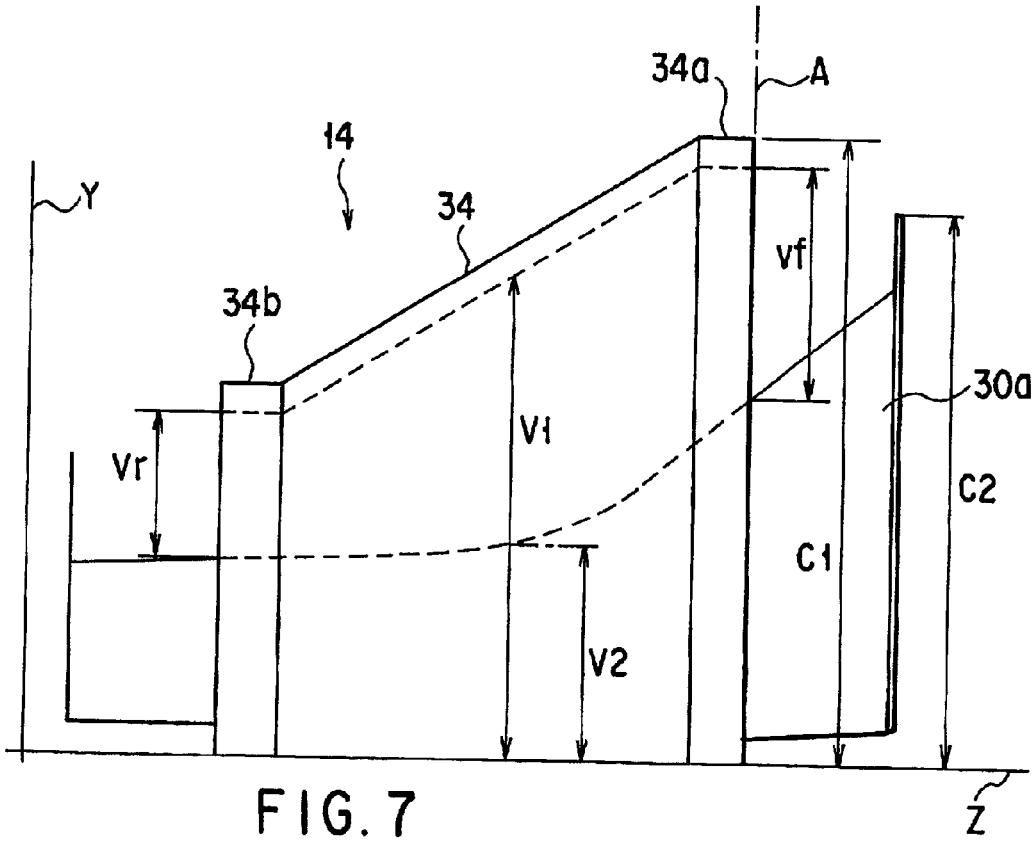
FIG. 7 is a side view schematically showing a configuration of a core and a horizontal deflection coil of the deflection yoke.
Figure 8:
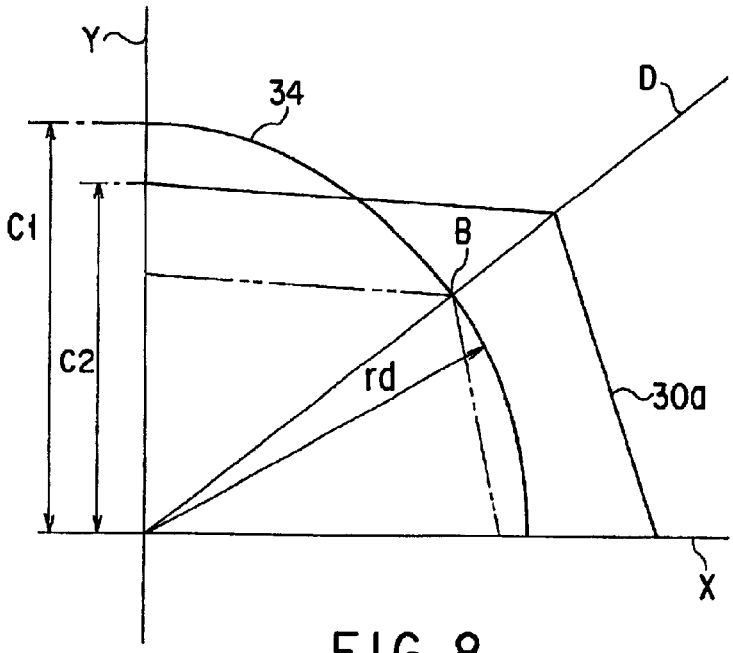
FIG. 8 is a diagram schematically showing the relation between the respective radii of a large-diameter end portion of the core and the horizontal deflection coil of the deflection yoke.

As shown in FIGS. 7 and 8, therefore, the outer radius of a large-diameter end portion 34*a* of the core 34 is adjusted to a radius (rd) that is substantially equal to the diagonal radius of each of the horizontal deflection coils 30*a* and 30*b* in a position B where a plane A that contains the large-diameter end portion 34*a* and extends at right angles to the tube axis Z and the diagonal axis of each horizontal deflection coil cross each other.

Figure 9:
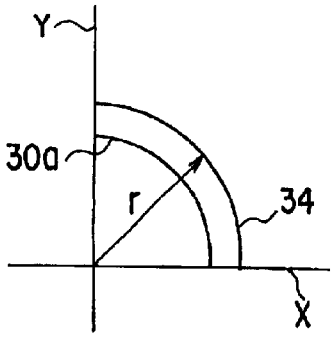
FIG. 9 is a diagram schematically showing a configuration of a small-diameter end portion of the core and the horizontal deflection coil of the deflection yoke.
Figure 10:
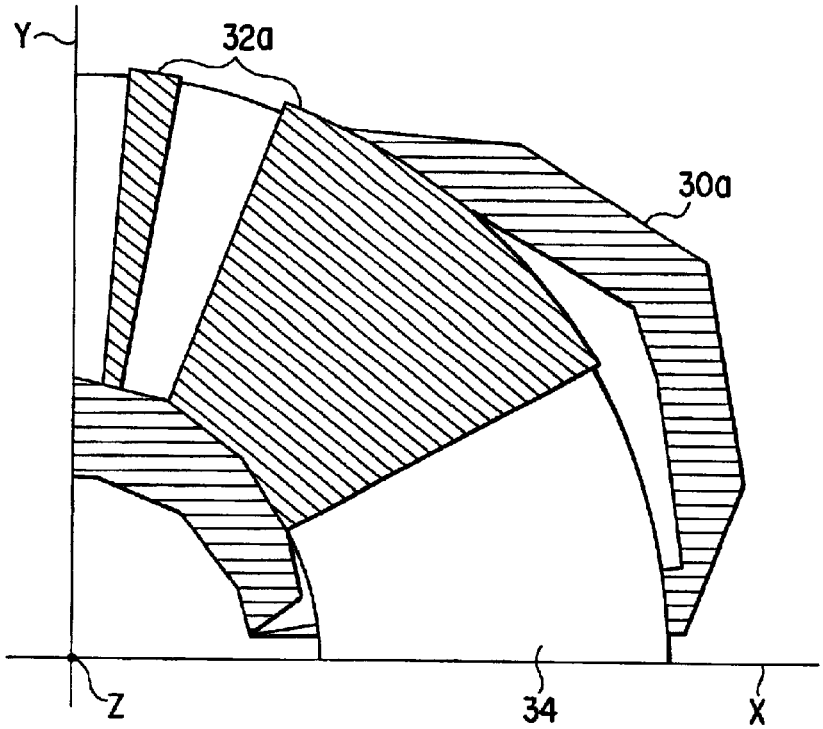
FIG. 10 is a diagram schematically showing the deflection yoke as viewed from the neck side.
Figure 15A:
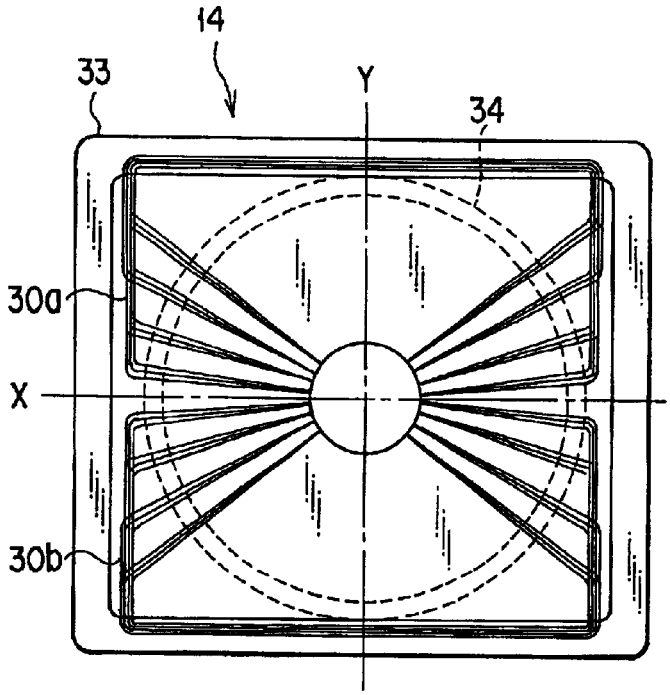
Figure 15B:
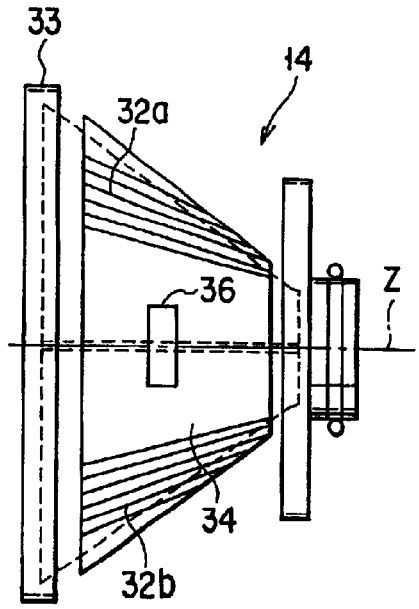
FIG. 15B is a side view of the deflection yoke.

Since the respective neck-side ends of the horizontal deflection coils 30*a* and 30*b* are substantially circular, moreover, the inner and outer radii of a rear-side or small-diameter end portion 34*b* of the core 34 are settled depending on the radius of the circle of each neck-side end. Thus, the inner radius of the small-diameter end portion 34*b* of the core 34 is adjusted to a radius (r) that is a little longer than the radius of the neck-side end of the horizontal deflection coils 30*a* and 30*b*, as shown in FIG. 9, in consideration of an allowance for the vertical deflection coils 32*a* and 32*b* that are toroidally wound on the core 34. The core 34 is formed in the shape of an optimum truncated cone in consideration of the respective radii rd and r of the large- and small-diameter end portions and the optimum length in the direction of the tube axis.

If the deflection yoke 14 is viewed sideways or in the direction of the horizontal axis X, as shown in FIG. 7, the radius of the core 34, in the shape of a truncated cone, in the direction of the vertical axis Y is not shorter than that of the horizontal deflection coils 30*a* and 30*b*, in the shape of a truncated pyramid, in any position in the direction of the tube axis Z. The gap between each horizontal deflection coil and the core 34 has its maximum dimension near the vertical axis of the deflection yoke 14.

In consideration of reduction of deflecting power and heat dissipation property, moreover, the relation between a space vf between the inner surface of the large-diameter end portion 34*a* of the core 34 and each of the horizontal deflection coils 30*a* and 30*b* and a space vr between the inner surface of the small-diameter end portion 34*b* of the core and each horizontal deflection coil, with respect to the direction of the vertical axis Y, is given by vf≧vr.

In consideration of reduction of deflecting power and heat dissipation property, furthermore, the space between the inner surface of the core 34 and each of the horizontal deflection coils 30*a* and 30*b*, with respect to the direction of the vertical axis Y, is set so as to enlarge gradually from the small-diameter end portion 34*b* of the core 34 to the large-diameter end portion 34*a*. This enlargement of the gap is not limited to a monotonous or constant enlargement and includes a variable-rate enlargement. In short, this enlargement includes no decremental factors. There are some winding-free portions on the respective vertical profiles of the horizontal deflection coils 30*a* and 30*b*. In FIG. 7, however, an outline of the horizontal deflection coil 30*a* as viewed in the horizontal direction is represented by a broken-line projection. The above-mentioned configuration is prepared including the space between the broken-line portion and the inner surface of the core.

If the deflection yoke 14 is viewed from the neck side, as shown in FIGS. 7 to 10, moreover, the core 34, the saddle-type horizontal deflection coils 30*a* and 30*b* in the shape of a truncated pyramid, and the vertical deflection coils 32*a* and 32*b* toroidally wound on the core are arranged in a relation:

core radius V1≧radius V2 of each horizontal deflection coil with respect to any position on the vertical axis Y. The gap between each horizontal deflection coil and the core 34 has its maximum dimension near the vertical axis-Y of the deflection yoke 14.

According to the color cathode ray tube apparatus constructed in this manner, the yoke mounting portion 15 of the vacuum envelope 10 is in the shape of a truncated pyramid, and besides, each of the horizontal deflection coils 30*a* and 30*b* is in the shape of a truncated pyramid that extends along the yoke mounting portion. Accordingly, the radii of the horizontal deflection coils 30*a* and 30*b* in the directions of the horizontal and vertical axes X and Y can be shortened to bring the coils 30*a* and 30*b* close to the electron beams without changing the radius in the diagonal direction in which the electron beams deflect at the widest angle. In consequence, the electron beams can be deflected efficiently, and the deflecting power of the deflection yoke 14 can be lowered.

Further, the core 34 is formed having the shape of a truncated cone, and the vertical deflection coils 32*a* and 32*b* are wound toroidally. Therefore, the manufacturing cost of the deflection yoke can be made lower than in the case where a core in the shape of a truncated pyramid is used, without failing to maintain satisfactory properties of the yoke. Depending on the dimensional relations between the core 34 and the horizontal deflection coils 30*a* and 30*b*, leakage magnetic fields of the horizontal deflection coils can be absorbed in some measure by means of the core.

Furthermore, the core 34 is formed in the shape of a truncated cone, and the space vf between the large-diameter end portion of the core 34 and each of the horizontal deflection coils 30*a* and 30*b* and the space vr between the small-diameter end portion of the core and each horizontal deflection coil are adjusted to the relation vf≧vr. By doing this, the deflecting power can be lowered, and heat can be easily released from the horizontal deflection coils, so that increase in temperature of the deflection yoke 14 can be fully restrained even if the deflection frequency is high.

Besides, the space between the core 34 and each of the horizontal deflection coils 30*a* and 30*b* in the direction of the vertical axis enlarges from the small-diameter end portion of the core 34 to the large-diameter end portion. Thus, the deflecting power can be lowered further, and heat can be easily released from the horizontal deflection coils 30*a* and 30*b*, so that increase in temperature of the deflection yoke 14 can be restrained.

By way of example, an optimum form was simulated for the deflection yoke 14 of a flat cathode ray tube having a diagonal dimension of 76 cm and a panel with a substantially perfect flat surface. In the case of a conventional a deflection yoke of a saddle-saddle type that is basically composed of horizontal and vertical deflection coils and a core in the shape of a truncated pyramid each, in consequence, the space vf between the large-diameter end portion of the core and each horizontal deflection coil and the space vr between the small-diameter end portion of the core and each horizontal deflection coil were vf=6.6 mm and vr=6.1 mm, respectively, so that vf/vr was about 1.1.

On the other hand, vf=26.8 mm, vr=5.6 mm, and vf/vr= about 4.8 are obtained in the case of a semi-toroidal deflection yoke in which the vertical deflection coils 32*a* and 32*b* are toroidally wound on the core 34 in the shape of a truncated cone and the horizontal deflection coils 30*a* and

30*b* are wound like saddles or in the shape of a truncated pyramid, as in the case of the present embodiment.

If the distance from the small-diameter side end of the core 34 in the direction of the tube axis Z is Z, in the example, the gap between the core 34 and each of the horizontal deflection coils 30*a* and 30*b* in the vertical direction and the gap between the core and the separator 33 enlarge gradually, as shown in FIGS. 11 and 12. Further, the outer diameters C1=53.6 mm and C2=50.9 mm are given at the respective large-diameter end portions of the core 34 and the horizontal deflection coils 30*a* and 30*b*.

For the semi-toroidal deflection yoke according to the present embodiment, moreover, reduction of the deflecting power and improvement of the heat dissipation property can be effected when the value of vf/vr ranges from 3.0 to 7.0, and about 5.0 is the optimum value for vf/vr, as shown in FIGS. 13 and 14. Thus, the deflecting power and heat release value can be lowered with use of the deflection yoke according to the present embodiment.

The following is a description of a deflection yoke of a color cathode ray tube apparatus according to a second embodiment of the invention. In the description to follow, like reference numerals are used to designate like portions of the first and second embodiments, and a description of those portions is omitted.

According to the second embodiment, a deflection yoke 14, like the one according to the foregoing embodiment, comprises a core 34 in the shape of a truncated cone, saddle-type horizontal deflection coils 30*a* and 30*b* in the shape of truncated pyramid, vertical deflection coils 32*a* and 32*b* toroidally wound on the core, and a separator 33 in the shape of a truncated pyramid.

Figure 16:
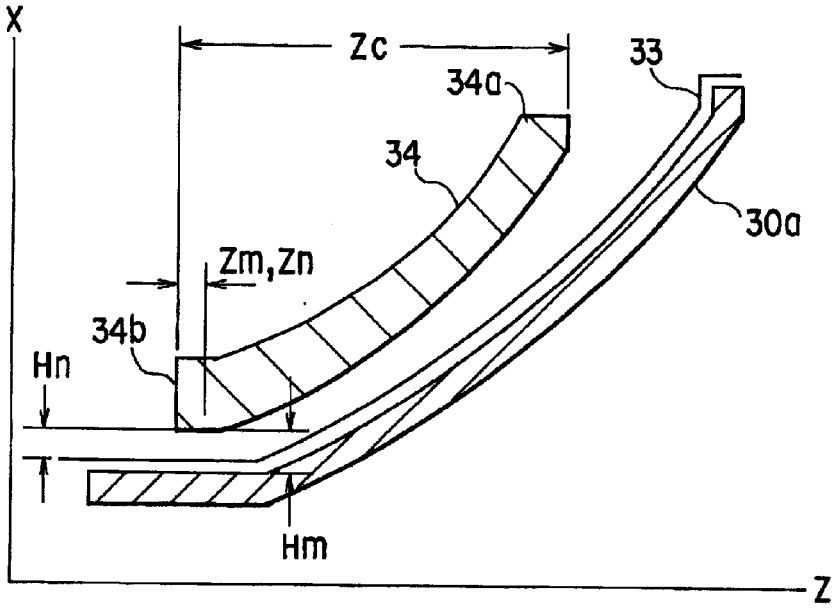

In consideration of reduction of deflecting power and heat dissipation property, the space between the core 34, in the shape of a truncated cone, and each of the saddle-type horizontal deflection coils 30*a* and 30*b*, in the shape of a truncated pyramid, with respect to the direction of the horizontal axis X, is set so as to enlarge gradually from the small-diameter end portion of the core 34 to the large-diameter end portion, as shown in FIG. 16. Thus, the small-diameter end portion of the core 34 has a minimum space portion that is kept at a minimum space Hm from each horizontal deflection coil in a position at a distance Zm from the small-diameter end of the core in the direction of the tube axis Z. This minimum space portion is situated overlapping a fixed-diameter portion of a neck 3. The space between the core 34 and each of the saddle-type horizontal deflection coils 30*a* and 30*b*, with respect to the direction of the horizontal axis X, is set so as to enlarge gradually from the minimum space portion to the large-diameter end portion the core 34. This enlargement of the gap is not limited to a monotonous or constant enlargement and includes a variable-rate enlargement. In short, this enlargement includes no decremental factors.

Likewise, the space between the core 34, in the shape of a truncated cone, and the separator 33, with respect to the direction of the horizontal axis X, is set so as to enlarge gradually from the small-diameter end portion of the core 34 to the large-diameter end portion, in consideration of reduction of deflecting power and heat dissipation property. Thus, the small-diameter end portion of the core 34 has a minimum space portion that is kept at a minimum space Hn in a position at a distance Zn from the small-diameter end of the core in the direction of the tube axis Z. The space between the core 34 and the separator 33 is set so as to enlarge gradually from the minimum space portion to the large-diameter end portion the core 34.

In consideration of reduction of deflecting power and heat dissipation property, moreover, the space between the core 34, in the shape of a truncated cone, and each of the saddle-type horizontal deflection coils 30*a* and 30*b*, in the shape of a truncated pyramid, with respect to the direction of the vertical axis Y, is set so as to enlarge gradually from the small-diameter end portion of the core 34 to the large-diameter end portion, as shown in FIG. 17. Thus, the small-diameter end portion of the core 34 has a minimum space portion that is kept at the minimum space Hm from each horizontal deflection coil in the position at the distance Zm from the small-diameter end of the core in the direction of the tube axis Z. This minimum space portion is situated overlapping the fixed-diameter portion of the neck 3. The space between the core 34 and each of the saddle-type horizontal deflection coils 30*a* and 30*b*, with respect to the direction of the vertical axis Y, is set so as to enlarge gradually from the minimum space portion to the large-diameter end portion the core 34. This enlargement of the gap is not limited to a monotonous or constant enlargement and includes a variable-rate enlargement. In short, this enlargement includes no decremental factors.

Likewise, the space between the core 34, in the shape of a truncated cone, and the separator 33, with respect to the direction of the vertical axis Y, is set so as to enlarge gradually from the small-diameter end portion of the core 34 to the large-diameter end portion, in consideration of reduction of deflecting power and heat dissipation property. Thus, the small-diameter end portion of the core 34 has a minimum space portion that is kept at the minimum space Hn in the position at the distance Zn from the small-diameter end of the core in the direction of the tube axis Z. The space between the core 34 and the separator 33 is set so as to enlarge gradually from the minimum space portion to the large-diameter end portion the core 34.

In a color cathode ray tube apparatus having a diagonal dimension of 76 cm, by way of example, a deflection yoke 14 is a semi-toroidal deflection yoke that includes vertical deflection coils 32*a* and 32*b* of a toroidal type wound on a core 34 in the shape of a truncated cone and saddle-type horizontal deflection coils 30*a* and 30*b* in the shape of a truncated pyramid. The space between the core 34 and each of the horizontal deflection coils 30*a* and 30*b*, with respect to both the directions of the horizontal and vertical axes X and Y, has its minimum in a position at a distance of 2 mm on the panel side from the small-diameter end of the core 34, and the gap enlarges gradually to the large-diameter end portion of the core 34.

A length Zc of the core 34 in the direction of the tube axis Z is 37 mm, and the position where the space between the core 34 and each of the horizontal deflection coils 30*a* and 30*b* has its minimum is at a distance equal to about 5.4% of the length of the core 34 from the small-diameter end of the core 34, in the direction of the tube axis Z.

Further, the deflection yoke 14 is provided with a separator 33 that is substantially similar to the horizontal deflection coils 30*a* and 30*b*. The space between the core 34 and the separator 33, with respect to both the directions of the horizontal and vertical axes X and Y, has its minimum in a position at a distance of 2 mm on the panel side from the small-diameter end of the core 34, and the gap enlarges gradually to the large-diameter end portion of the core 34.

In the example, the gaps between the core 34 and each horizontal deflection coil and between the core and the separator in the direction of the horizontal axis X gradually enlarges, as shown in FIGS. 18 and 19. Likewise, the gaps between the core 34 and each horizontal deflection coil and between the core and the separator in the direction of the vertical axis Y gradually enlarges, as shown in FIGS. 20 and 21.

As shown in FIGS. 22 and 23, moreover, the heat dissipation property of the deflection yoke 14 are better if the Z-direction distance Zm from the small-diameter end of the core 34 to the minimum space portion in which the space between the core 34 and each of the horizontal deflection coils 30*a* and 30*b* has its minimum and the Z-direction distance Zn from the small-diameter end of the core 34 to the minimum space portion in which the space between the core 34 and the separator 33 has its minimum are shorter. Further better heat dissipation property can be obtained if the distance Zm or Zn from the small-diameter end of the core 34 to the minimum space portion is adjusted to 30% or less of the Z-direction length Zc of the core 34, in particular.

The same functions and effects of the first embodiment can be obtained with use of the color cathode ray tube apparatus that is provided with the deflection yoke constructed in this manner. Further, the core 34 has the shape of a truncated cone, the minimum space portion in which the space between the core 34 and each of the horizontal deflection coils 30*a* and 30*b* has its minimum exists near the small-diameter end portion of the core 34 in the directions of the horizontal and vertical axes that extend at right angles to the central axis of each horizontal deflection coil, and the space between the core 34 and each horizontal deflection coil enlarges toward the large-diameter end portion of the core. Furthermore, the minimum space portion in which the space between the core 34 and the separator 33 has its minimum exists near the small-diameter end portion of the core 34 in the directions of the horizontal and vertical axes, and the space between the core 34 and the separator 33 enlarges toward the large-diameter end portion of the core. Thus, the deflecting power can be lowered, and heat can be easily released from the horizontal deflection coils, so that increase in temperature of the deflection yoke 14 can be restrained even if the deflection frequency is high.

The present invention is not limited to the embodiments described above, and various changes and modifications may be effected therein by one skilled in the art without departing from the scope or spirit of the invention. For example, the invention is not limited to a color cathode ray tube apparatus, and may be also applied to a monochromatic cathode ray tube apparatus.

According to the embodiments described above, the gap between each horizontal deflection coil or the separator enlarges from the small-diameter end portion of the core toward the large-diameter end with respect to both the directions of the horizontal and vertical axes. Alternatively, however, the gap may be made to enlarge from the small-diameter end portion of the core toward the large-diameter end portion with respect to only one of the directions of horizontal and vertical axes. The same functions and effects of the foregoing embodiments can be also obtained in this case.

According to the embodiments described above, moreover, both the gaps between the core and each horizontal deflection coil and between the core and the separator enlarge from the small-diameter end portion of the core toward the large-diameter end. Alternatively, however, the same functions and effects of the foregoing embodiments can be obtained with use of an arrangement such that at least one of the gaps between the core and each horizontal deflection coil and between the core and the separator enlarges from the small-diameter end portion of the core toward the large-diameter end portion.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A deflection yoke comprising:

a pair of saddle-type horizontal deflection coils located symmetrically with respect to a central axis on the opposite sides of a horizontal axis perpendicular to the central axis, individually, and substantially in the shape of a truncated pyramid as a whole;

a magnetic core substantially in the shape of a truncated cone located coaxially with the central axis and surrounding the horizontal deflection coils, the magnetic core including a large-diameter end portion and a small-diameter end portion; and a pair of vertical deflection coils wound on the magnetic core, the horizontal deflection coils and the magnetic core being arranged so that a space vf between the large-diameter end portion of the magnetic core and each of the horizontal deflection coils is 3 times to 7 times as wide as a space vr between the small-diameter end portion of the magnetic core and each of the horizontal deflection coils, with respect to the direction of a vertical axis perpendicular to the central axis and the horizontal axis as viewed in the direction of the horizontal axis.

2. A deflection yoke according to claim 1, wherein the space vf is about 5 times as wide as the space vr.

3. A deflection yoke according to claim 1, which further comprises a separator substantially in the shape of a truncated pyramid, the horizontal deflection coils being arranged along an inner surface of the separator, and the magnetic core being located outside the separator.

4. A deflection yoke according to claim 1, wherein the gap between an inner surface of the magnetic core and each of the horizontal deflection coils in the direction of the vertical axis increases continuously from the small-diameter end portion of the magnetic core to the large-diameter end portion.

5. A deflection yoke according to claim 4, wherein the gap between the inner surface of the magnetic core and each of the horizontal deflection coils in the direction of the horizontal axis increases continuously from the small-diameter end portion of the magnetic core to the large-diameter end portion.

6. A cathode ray tube apparatus comprising:

a vacuum envelope including a panel with a phosphor screen formed on an inner surface thereof, a funnel connected to the panel, a cylindrical neck connected to a small-diameter end of the funnel, and a yoke mounting portion in the shape of a truncated pyramid covering the outer periphery from the neck to the funnel;

an electron gun arranged in the neck of the vacuum envelope and configured to emit electron beams toward the phosphor screen; and a deflection yoke mounted on the outside of the yoke mounting portion and configured to deflect the electron beams, the deflection yoke including a pair of saddle-type horizontal deflection coils located symmetrically with respect to a central axis on the opposite sides of a horizontal axis perpendicular to the central axis, individually, and substantially in the shape of a truncated pyramid as a whole, a magnetic core substantially in the shape of a truncated cone located coaxially with the central axis and surrounding the horizontal deflection coils, the magnetic core including a large-diameter end portion and a small-diameter end portion, and a pair of vertical deflection coils wound on the magnetic core, the horizontal deflection coils and the magnetic core being arranged so that a space vf between the large-diameter end portion of the magnetic core and each of the horizontal deflection coils is 3 times to 7 times as wide as a space vr between the small-diameter end portion of the magnetic core and each of the horizontal deflection coils, with respect to the direction of a vertical axis perpendicular to the central axis and the horizontal axis as viewed in the direction of the horizontal axis.

7. A deflection yoke comprising:

a pair of saddle-type horizontal deflection coils located symmetrically with respect to a central axis on the opposite sides of a horizontal axis perpendicular to the central axis, individually, and substantially in the shape of a truncated pyramid as a whole;

a magnetic core substantially in the shape of a truncated cone located coaxially with the central axis and surrounding the horizontal deflection coils, the magnetic core including a large-diameter end portion and a small-diameter end portion; and a pair of vertical deflection coils wound on the magnetic core, the horizontal deflection coils and the magnetic core being arranged so that a minimum space portion in which the space between the magnetic core and each of the horizontal deflection coils in the direction of the horizontal axis has a minimum is provided near the small-diameter end portion of the core and that the space between the core and each horizontal deflection coil in the direction of the horizontal axis enlarges continuously from the minimum space portion to the large-diameter end of the core.

8. A deflection yoke according to claim 7, wherein the minimum space portion is situated at a distance equal to 30% or less of the length of the magnetic core along the central axis from the small-diameter end of the core.

9. A deflection yoke according to claim 7, which further comprises a separator substantially in the shape of a truncated pyramid, the horizontal deflection coils being arranged along an inner surface of the separator, the magnetic core being located outside the separator, the horizontal deflection coils and the magnetic core being arranged so that a minimum space portion in which the space between the magnetic core and the separator in the direction of the horizontal axis has a minimum is provided near the small-diameter end portion of the core and that the space between the core and the separator in the direction of the horizontal axis enlarges continuously from the minimum space portion to the large-diameter end of the core.

10. A deflection yoke comprising:

a pair of saddle-type horizontal deflection coils located symmetrically with respect to a central axis on the opposite sides of a horizontal axis perpendicular to the central axis, individually, and substantially in the shape of a truncated pyramid as a whole;

a separator located outside the horizontal deflection coils and substantially similar to the horizontal deflection coils in shape;

a magnetic core substantially in the shape of a truncated cone located coaxially with the central axis and surrounding the separator, the magnetic core including a large-diameter end portion and a small-diameter end portion; and a pair of vertical deflection coils wound on the magnetic core, the horizontal deflection coils and the magnetic core being arranged so that a minimum space portion in which the space between the magnetic core and the separator in the direction of the horizontal axis has a minimum is provided near the small-diameter end portion of the core and that the space between the core and the separator in the direction of the horizontal axis enlarges continuously from the minimum space portion to the large-diameter end of the core.

11. A deflection yoke according to claim 10, wherein the minimum space portion is situated at a distance equal to 30% or less of the length of the magnetic core along the central axis from the small-diameter end of the core.

12. A deflection yoke according to claim 10, wherein a minimum space portion in which the space between the magnetic core and the separator in the direction of a vertical axis perpendicular to the central axis and the horizontal axis has a minimum is provided near the small-diameter end portion of the core, and the space between the core and the separator in the direction of the vertical axis enlarges continuously from the minimum space portion to the large-diameter end of the core.

13. A cathode ray tube apparatus comprising:

a vacuum envelope including a panel with a phosphor screen formed on the inner surface thereof, a funnel connected to the panel, a cylindrical neck connected to a small-diameter end of the funnel, and a yoke mounting portion in the shape of a truncated pyramid covering the outer periphery from the neck to the funnel;

an electron gun arranged in the neck of the vacuum envelope and configured to emit electron beams toward the phosphor screen; and a deflection yoke mounted on the outside of the yoke mounting portion and configured to deflect the electron beams in horizontal and vertical directions, the deflection yoke including a pair of saddle-type horizontal deflection coils located symmetrically with respect to a central axis on the opposite sides of a horizontal axis perpendicular to the central axis, individually, and substantially in the shape of a truncated pyramid as a whole, a magnetic core substantially in the shape of a truncated cone located coaxially with the central axis and surrounding the horizontal deflection coils, the magnetic core including a large-diameter end portion and a small-diameter end portion, and a pair of vertical deflection coils wound on the magnetic core, the horizontal deflection coils and the magnetic core being arranged so that a minimum space portion in which the space between the magnetic core and each of the horizontal deflection coils in the direction of the horizontal axis has a minimum is provided near the small-diameter end portion of the core and that the space between the core and each horizontal deflection coil in the direction of the horizontal axis enlarges continuously from the minimum space portion to the large-diameter end of the core.

14. A deflection yoke comprising:

a pair of saddle-type horizontal deflection coils located symmetrically with respect to a central axis on the opposite sides of a horizontal axis perpendicular to the central axis, individually, and substantially in the shape of a truncated pyramid as a whole;

a magnetic core substantially in the shape of a truncated cone located coaxially with the central axis and surrounding the horizontal deflection coils, the magnetic core including a large-diameter end portion and a small-diameter end portion; and a pair of vertical deflection coils wound on the magnetic core, the horizontal deflection coils and the magnetic core being arranged so that the relation between the respective radii of the core and each of the horizontal deflection coils in the direction of a vertical axis perpendicular to the central axis have a relation:

radius of magnetic core≧radius of each horizontal deflection coil at the large-diameter end portion of the core.

15. A deflection yoke according to claim 14, which further comprises a separator substantially in the shape of a truncated pyramid, the horizontal deflection coils being arranged along an inner surface of the separator, and the magnetic core being located outside the separator.

16. A cathode ray tube apparatus comprising:

a vacuum envelope including a panel with a phosphor screen formed on the inner surface thereof, a funnel connected to the panel, a cylindrical neck connected to the small-diameter end of the funnel, and a yoke mounting portion in the shape of a truncated pyramid covering the outer periphery from the neck to the funnel;

an electron gun arranged in the neck of the vacuum envelope and configured to emit electron beams toward the phosphor screen; and a deflection yoke mounted on the outside of the yoke mounting portion and configured to deflect the electron beams, the deflection yoke including a pair of saddle-type horizontal deflection coils located symmetrically with respect to a central axis on the opposite sides of a horizontal axis perpendicular to the central axis, individually, and substantially in the shape of a truncated pyramid as a whole, a magnetic core substantially in the shape of a truncated cone located coaxially with the central axis and surrounding the horizontal deflection coils, the magnetic core including a large-diameter end portion and a small-diameter end portion, and a pair of vertical deflection coils wound on the magnetic core, the horizontal deflection coils and the magnetic core being arranged so that the relation between the respective radii of the core and each of the horizontal deflection coils in the direction of a vertical axis perpendicular to the central axis have a relation:

radius of magnetic core≧radius of each horizontal deflection coil at the large-diameter end portion of the core.

* * * * *